US010808382B2

(12) United States Patent
Taylor et al.

(10) Patent No.: US 10,808,382 B2
(45) Date of Patent: Oct. 20, 2020

(54) SYSTEMS AND METHODS OF PREVENTING A RUN-AWAY STATE IN AN INDUSTRIAL MACHINE

(71) Applicant: Joy Global Surface Mining Inc, Milwaukee, WI (US)

(72) Inventors: Wesley P. Taylor, Glendale, WI (US); Paul S. Ryan, Mukwonago, WI (US); Bryant J. Delforce, Milwaukee, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 94 days.

(21) Appl. No.: 15/806,491

(22) Filed: Nov. 8, 2017

(65) Prior Publication Data

US 2018/0127951 A1 May 10, 2018

Related U.S. Application Data

(60) Provisional application No. 62/419,582, filed on Nov. 9, 2016.

(51) Int. Cl.
*G06F 7/70* (2006.01)
*E02F 9/24* (2006.01)
(Continued)

(52) U.S. Cl.
CPC ..... *E02F 9/24* (2013.01); *E02F 9/2025* (2013.01); *E02F 9/226* (2013.01); *E02F 9/265* (2013.01);
(Continued)

(58) Field of Classification Search
CPC . E02F 9/24; E02F 9/2025; E02F 9/226; E02F 3/308; E02F 9/265; E02F 9/268; E02F 3/46
(Continued)

(56) References Cited

U.S. PATENT DOCUMENTS 6,014,598 A 1/2000 Duyar et al.
6,194,856 B1 2/2001 Kobayashi et al.
(Continued)

FOREIGN PATENT DOCUMENTS

CN 101680204 3/2010
CN 102535556 7/2012
(Continued)

OTHER PUBLICATIONS

Chilean Patent Office Action and Search Report for Application No. 201702810 dated Jul. 12, 2019 (11 pages including statement of relevance).
(Continued)

*Primary Examiner* — Shardul D Patel
(74) *Attorney, Agent, or Firm* — Michael Best & Friedrich LLP

(57) ABSTRACT

A system and method for preventing a run-away state of an industrial machine. Joints of the industrial machine are monitored in order to determine if the industrial machine is in danger of entering a run-away state. If a joint parameter exceeds a threshold value, which is indicative of the potential to enter a run-away state, then a force or torque limit is increased so that the industrial machine has additional force or torque to slow down the industrial machine when decelerating. This additional torque prevents the industrial machine from entering the run-away state.

24 Claims, 10 Drawing Sheets

(51) Int. Cl.

| | |
|---|---|
| ***E02F 9/26*** | (2006.01) |
| ***E02F 9/20*** | (2006.01) |
| ***E02F 9/22*** | (2006.01) |
| *E02F 3/46* | (2006.01) |
| *E02F 3/30* | (2006.01) |

(52) U.S. Cl.
CPC ..... *E02F 9/268* (2013.01); *E02F 3/308* (2013.01); *E02F 3/46* (2013.01)

(58) Field of Classification Search
USPC ..... 701/50, 33.9; 702/184; 37/348; 606/130; 318/565
See application file for complete search history.

(56) References Cited

U.S. PATENT DOCUMENTS 6,297,610 B1 10/2001 Bauer et al.
6,338,024 B1 1/2002 Taniguchi et al.
6,704,875 B1 3/2004 Kinoshita et al.
7,894,917 B2 2/2011 Weatherhead et al.
8,214,455 B2 7/2012 Baier et al.
8,229,575 B2 7/2012 Vasko et al.
8,463,508 B2 * 6/2013 Nicholson ..... E02F 3/432 172/3
8,509,935 B2 8/2013 Hoyle et al.
9,809,949 B2 * 11/2017 Voelz ..... E02F 9/265
2007/0191968 A1 * 8/2007 Sikka ..... G06F 8/20 700/1
2008/0282583 A1 * 11/2008 Koellner ..... E02F 3/304 37/348
2011/0153091 A1 * 6/2011 Nicholson ..... E02F 3/432 700/279
2011/0282630 A1 * 11/2011 Rikkola ..... G05B 23/0232 702/184
2012/0092180 A1 * 4/2012 Rikkola ..... G05B 23/0232 340/679
2012/0158012 A1 * 6/2012 Sandhu ..... H02H 7/0833 606/130
2012/0277959 A1 11/2012 Colwell et al.
2012/0310494 A1 12/2012 Asami et al.
2013/0193894 A1 8/2013 Kiguchi et al.
2013/0234642 A1 9/2013 Igarashi et al.
2013/0241460 A1 * 9/2013 Ushiyama ..... G05B 19/4062 318/565
2013/0249336 A1 9/2013 Voelz et al.
2014/0236432 A1 * 8/2014 Haisler ..... E21C 35/04 701/50
2015/0020452 A1 * 1/2015 Chen ..... E06B 7/09 49/82.1
2015/0308073 A1 * 10/2015 Voelz ..... E02F 9/265 701/50

FOREIGN PATENT DOCUMENTS

CN 103362170 10/2013
JP S60-167003 8/1985
WO 2012148436 A1 11/2012
WO 2012148437 A1 11/2012

OTHER PUBLICATIONS

Office Action issued by the Chinese Patent Office for related Application No. 201510205429.9 dated Jun. 20, 2018 (6 pages including Statement of Relevance).
Rockwell Automation, "Intellignet Motor Control:The Piece That Helps Make it Come Together," brochure (2008) pp. 1-132 USA.
Chilean Patent Office Action for Application No. 2015-001080 dated Dec. 13, 2017 (7 pages including Statement of Relevance).

* cited by examiner

SYSTEMS AND METHODS OF PREVENTING A RUN-AWAY STATE IN AN INDUSTRIAL MACHINE

RELATED APPLICATIONS

This application claims the benefit of U.S. Provisional Patent Application No. 62/419,582, filed Nov. 9, 2016, the entire content of which is hereby incorporated by reference.

SUMMARY

This application relates to the control of an industrial machine.

Due to operating variability, maintenance practices, and other unknown circumstances, an industrial machine, such as a mining machine, can experience loading that may exceed or approach the limits for which the industrial machine was designed. In these circumstances, the industrial machine has the potential to lose control authority of one or more joints, causing the machine to enter a run-away state. An industrial machine in a run-away state may cause damage to the industrial machine or other equipment.

Embodiments of the present invention provide a system and method for preventing a run-away state of an industrial machine. Industrial machine joints are monitored in order to determine when the industrial machine has the potential to enter a run-away state. If joint parameters exceed a threshold, which is indicative of the potential to enter a run-away state, then a force limit (e.g., a torque limit) is increased. The industrial machine is then able to provide additional force or torque beyond a default torque limit. This additional force or torque is applied to the industrial machine during deceleration, preventing the machine from entering a run-away state.

In one embodiment, the invention provides a computer-implemented method of preventing a run-away state of an industrial machine. The industrial machine includes a processor, a sensor, a motor driver, and a motor. The method includes setting, using the processor, a torque limit for a joint of the industrial machine to a first torque limit value, obtaining, using the processor, a joint parameter for the joint of the industrial machine based on an output signal from the sensor, and comparing, using the processor, the joint parameter for the joint to a joint parameter threshold value. The method also includes increasing, using the processor, the torque limit for the joint of the industrial machine to a second torque limit value based on the comparison of the joint parameter for the joint to the joint parameter threshold value when the joint parameter is greater than or equal to the joint parameter threshold value, and applying, using the motor drive and the motor, torque to the joint of the industrial machine. The torque applied to the joint of the industrial machine is limited to the second torque limit value.

In another embodiment, the invention provides an industrial machine that includes a joint, a joint sensor, a motor driver associated with the joint, a motor associated with the motor driver and the joint, and a controller. The controller is coupled to the joint sensor and the motor driver. The controller includes a non-transitory computer readable medium and a processor. The controller includes computer executable instructions stored in the computer readable medium for controlling operation of the industrial machine to set a torque limit for a joint to a first torque limit value, obtain a joint parameter for the joint based on an output signal from the joint sensor, compare the joint parameter for the joint to a joint parameter threshold value, and increase the torque limit for the joint to a second torque limit value based on the comparison of the joint parameter for the joint to the joint parameter threshold value when the joint parameter is greater than or equal to the joint parameter threshold value. The motor driver and the motor are configured to apply torque to the joint. The torque is limited to the second torque limit value.

In another embodiment, the invention provides a controller for preventing a run-away state of an industrial machine. The controller includes a non-transitory computer readable medium and a processor. The controller includes computer executable instructions stored in the computer readable medium for controlling operation of the industrial machine to set a torque limit for a joint of the industrial machine to a first torque limit value, obtain a joint parameter for the joint of the industrial machine based on an output signal from a sensor, compare the joint parameter for the joint to a joint parameter threshold value, increase the torque limit for the joint of the industrial machine to a second torque limit value based on the comparison of the joint parameter for the joint to the joint parameter threshold value when the joint parameter is greater than or equal to the joint parameter threshold value, and apply torque to the joint of the industrial machine. The torque is limited to the second torque limit value.

Before any embodiments of the invention are explained in detail, it is to be understood that the invention is not limited in its application to the details of the configuration and arrangement of components set forth in the following description or illustrated in the accompanying drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the invention. For example, "servers" and "computing devices" described in the specification can include one or more processing units, one or more computer-readable medium modules, one or more input/output interfaces, and various connections (e.g., a system bus) connecting the components.

Other aspects of the invention will become apparent by consideration of the detailed description and accompanying drawings.

DETAILED DESCRIPTION

Figure 1:
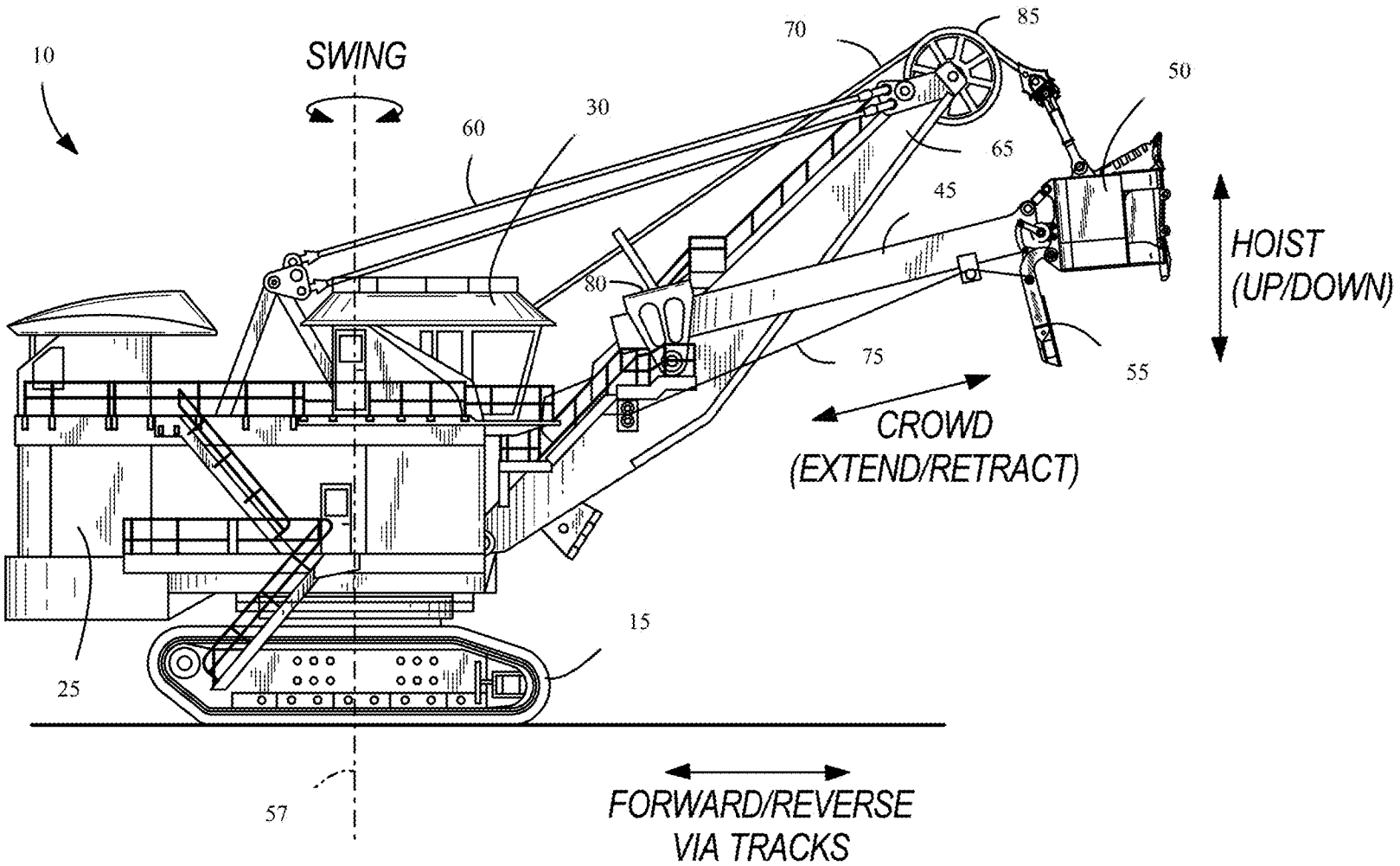
FIG. 1 illustrates an industrial machine according to an embodiment of the invention.

Although the invention described herein can be applied to, performed by, or used in conjunction with a variety of industrial machines (e.g., a rope shovel, a dragline, AC machines, DC machines, etc.), embodiments of the invention described herein are described with respect to an electric rope or power shovel, such as the power shovel 10 shown in FIG. 1. The power shovel 10 includes tracks 15 for propelling the shovel 10 forward and backward, and for turning the rope shovel 10 (i.e., by varying the speed and/or direction of left and right tracks relative to each other). The tracks 15 support a base 25 including a cab 30. The rope shovel 10 further includes a pivotable dipper handle 45 and an attachment 50. In this embodiment, the attachment 50 is illustrated as a dipper. The attachment 50 includes a door 55 for dumping contents of the attachment 50. Movement of the tracks 15 is not necessary for the swing motion. The base 25 is able to swing or swivel relative to the tracks 15 about a swing axis 57, for instance, to move the attachment 50 from a digging location to a dumping location.

The rope shovel 10 includes suspension cables 60 coupled between the base 25 and a boom 65 for supporting the boom 65. The rope shovel also includes a wire rope or hoist cable 70 that may be wound and unwound with in the base 25 to raise and lower the attachment 50, and a dipper trip cable 75 connected between another winch (not shown) and the door 55. The rope shovel 10 also includes a saddle block 80 and a sheave 85. In some embodiments, the rope shovel 10 is a P&H® 4100 series shovel produced by Joy Global Surface Mining.

The rope shovel 10 uses four main types of movement: forward and reverse, hoist, crowd, and swing. Forward and reverse moves the entire rope shovel 10 forward and backward using the tracks 15. Hoist moves the attachment 50 up and down. Crowd extends and retracts the attachment 50. Swing pivots the rope shovel around an axis 57. Overall movement of the rope shovel 10 utilizes one or a combination of forward and reverse, hoist, crowd, and swing.

Figure 2:
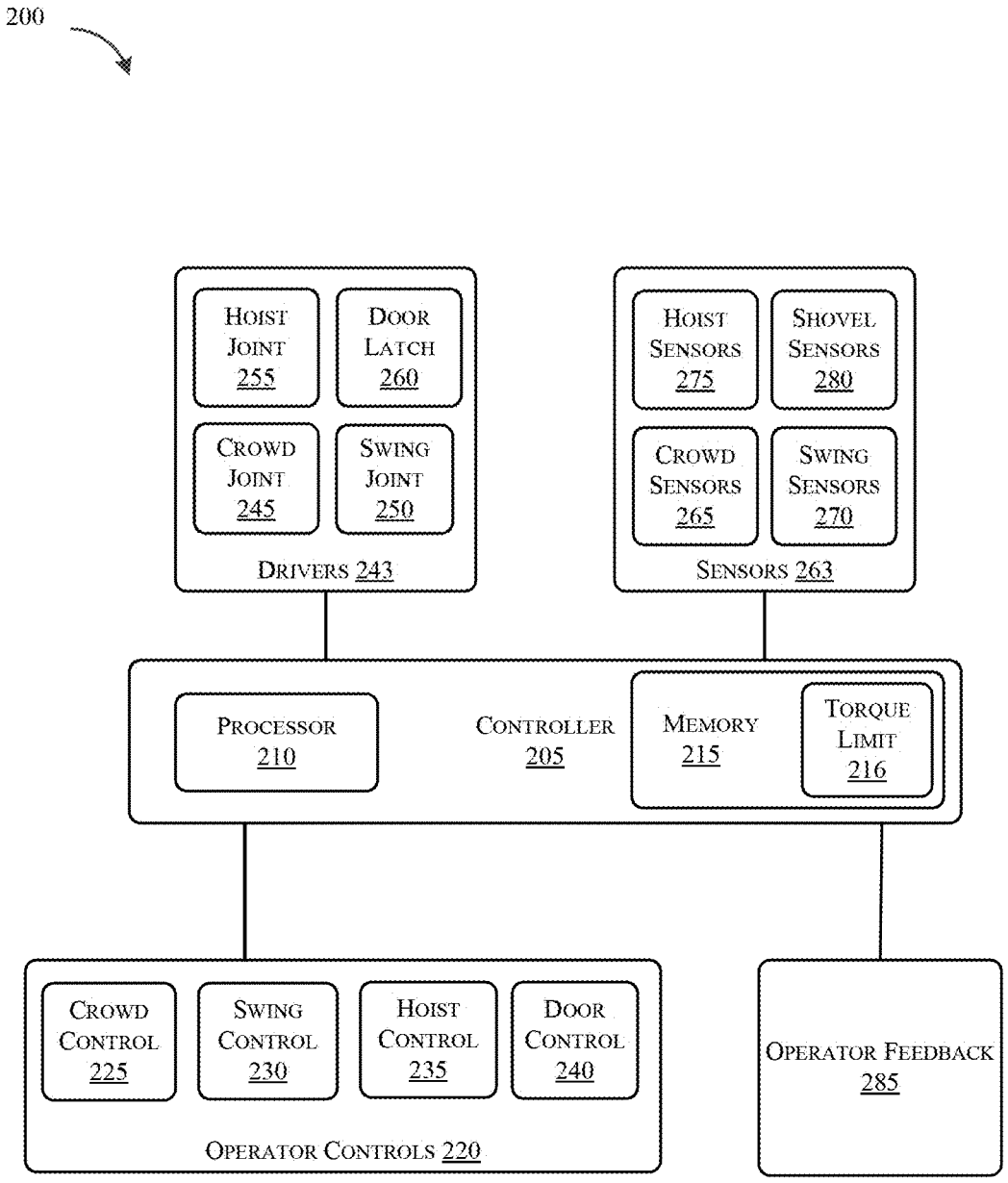
FIG. 2 illustrates a control system for an industrial machine according to an embodiment of the invention.

The rope shovel 10 includes a control system 200 including a controller 205, as shown in FIG. 2. The controller 205 includes a processor 210, which is an electronic processor, and a memory 215 (e.g., a non-transitory computer readable medium) for storing instructions executable by the processor 210. The memory 215 stores a torque limit 216. The torque limit 216 includes a default value of torque, when the rope shovel 10 is operating without any increased torque limit. The torque limit also includes the increased torque limit value if the torque limit is increased to a second value in order to prevent a run-away state. As described below, the processor 210 determines whether the default value or increased second value of torque limit is used. The controller 210 also includes various inputs/outputs for allowing communication between the controller 205 and the operator, sensors 263, and dipper controls 246, etc. In some embodiments, the controller 205 is a microprocessor, a digital signal processor (DSP), a field programmable gate array (FPGA), or an application specific integrated circuit (ASIC). The controller 205 can include a single controller or a plurality of controllers working together in the system.

The controller 205 receives input signals from operator controls 220, which includes a crowd control 225, a swing control 230, a hoist control 235, and a door control 240. The crowd control 225, swing control 230, hoist control 235, and door control 240 include, for example, operator controlled input devices such as joysticks, levers, foot pedals, and other actuators. The operator controls 220 receive operator input via the input devices and output motion commands as signals to the controller 205. The motion commands include, for example, hoist up, hoist down, crowd extend, crowd retract, swing clockwise, swing counterclockwise, dipper door release, left track forward, left track reverse, right track forward, and right track reverse. Upon receiving a motion command, the controller 205 generally controls the drivers 243, which includes drivers for one or more of a crowd joint 245, a swing joint 250, a hoist joint 255, and a shovel door latch 260 as commanded by the operator. For example, if the operator indicates via swing control 230 to rotate the handle 45 counterclockwise, the controller 205 controls the swing joint 250 to rotate the handle 45 counterclockwise. As described below, the controller 205 is operable to increase the torque limit during operation of the rope shovel 10 in order to prevent a run-away state.

The controller 205 is also in communication with a number of sensors 263 to monitor the location and status of the attachment 50. For example, the controller 205 is coupled to crowd sensors 265, swing sensors 270, hoist sensors 275, and shovel sensors 280. The crowd sensors 265 indicate to the controller 205 the level of extension or retraction of the attachment 50. The swing sensors 270 indicate to the controller 205 the swing angle, position, and velocity of the handle 45. The hoist sensors 275 indicate to the controller 205 the position or height of the attachment 50 based on the hoist cable 60 position, hoist force, hoist torque, hoist velocity, etc. The shovel sensors 280 indicate whether the dipper door 55 is open (e.g., for dumping) or closed. For example, as a hoist motor of the hoist joint 255 rotates to wind the hoist cable 60 and raise the attachment 50, the hoist sensors 275 output a signal indicating an amount of rotation of the hoist and a direction of movement. The controller 205 translates these output signals to a position, speed, and/or acceleration of the attachment 50.

Many different types of sensors may be used for the crowd sensors 265, swing sensors 270, hoist sensors 275, and shovel sensors 280. The shovel sensors 280 may include weight sensors, acceleration sensors, and inclination sensors to provide additional information to the controller 205 about the load within the attachment 50. In some embodiments, one or more of the crowd sensors, swing sensors 270, and hoist sensors 275 are resolvers that indicate an absolute position or relative movement of motors at the crowd joint 245, swing joint 250, and/or hoist joint 255. The crowd sensors 265, swing sensors 270, hoist sensors 275, and shovel sensors 280 may incorporate different types of sensors in other embodiments of the invention.

The operator feedback 285 provides information to the operator about the status of the rope shovel 10 and other systems communicating with the rope shovel 10. The operator feedback 285 includes one or more of a display (e.g. a liquid crystal display [LCD]), one or more light emitting diodes (LEDs) or other illumination devices, a heads-up display, speakers for audible feedback (e.g., beeps, spoken messages, etc.), tactile feedback devices such as vibration devices that cause vibration of the operator's seat or operator controls 220, or another feedback device. The processor 210 may store feedback in a data log on the memory 215 by logging events such as when the torque limit in a joint is increased to a second value in order to prevent a run-away state. In some embodiments, these logged events are sent to a remote datacenter for further storage and processing using a manual transfer (e.g., a universal serial bus ["USB"] flash drive, a secure digital ["SD"] card, etc.) or using a network. The data received can be accessed by a remote computer or server for processing and analysis. In some embodiments, the processed and analyzed information and data can be used to determine trends in increasing torque or to output reports.

Figure 3:
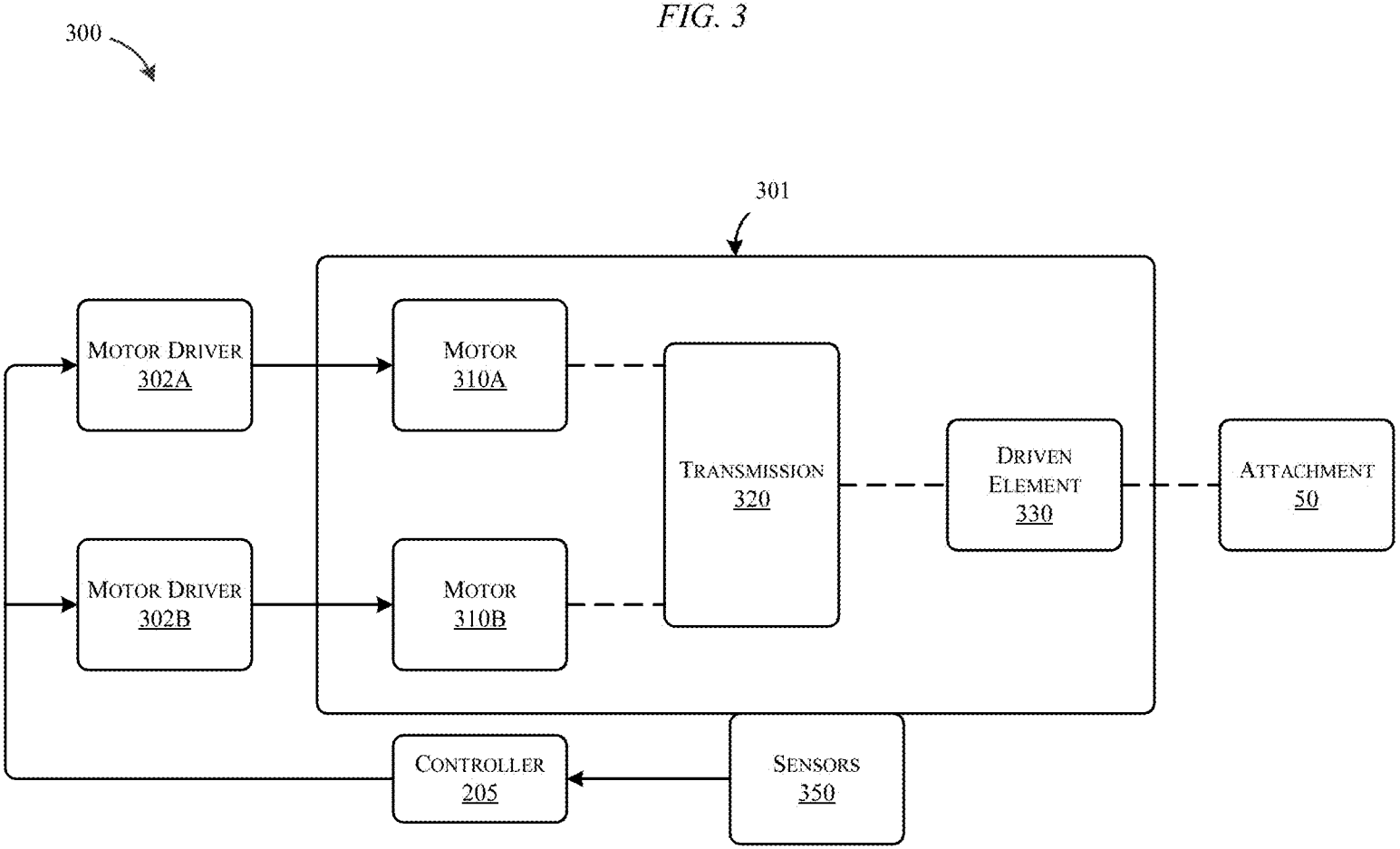
FIG. 3 illustrates a joint according to an embodiment of the invention.

FIG. 3 illustrates a block diagram of a joint system 300 including a joint 301. The joint 301 could be a hoist joint 255, crowd joint 245, swing joint 250, or another type of joint in an industrial machine. The joint 301 includes the various mechanisms used to move the particular joint. For example, in an example of the crowd joint 245, the joint 300 includes the mechanisms used to extend and retract the attachment 50. In the illustrated example, the joint system 300 includes a motor driver 302A and a motor driver 302B respectively driving motors 310A and 310B. The motor drivers 302A and 302B receive control signals from the controller 205 and, in response, provide power to the motors 310A and 310B, respectively. The motors 310A and 310B are coupled to a transmission 320, which receives and transfers the mechanical output of the motors 310A and 310B to mechanically drive a driven element 330. The controller 205 is coupled to and receives data from sensors 350 for monitoring the joint 301 and to determine a status of the joint 301, such as a position of the joint 301. The sensors 350 are, for example, the crowd sensors 265, swing sensors 270, hoist sensors 275, or shovel sensors 280. In the illustrated embodiment, the joint system 300 includes two motor drivers 302A and 302B. In other embodiments, the joint system 300 includes one or more than two motor drivers. In some embodiments, the joint system 300 includes more or fewer motors than the two illustrated motors 310A and 310B.

Figure 4:
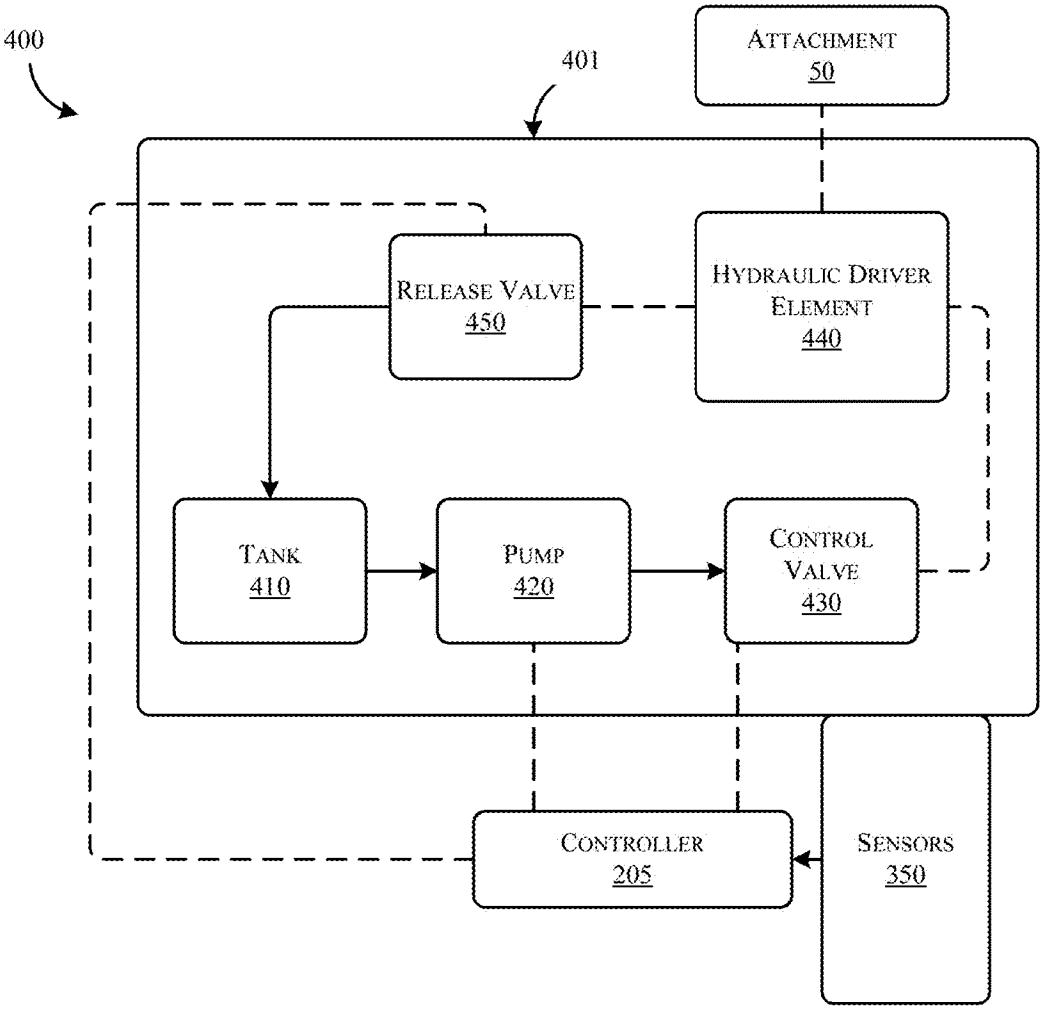
FIG. 4 illustrates a hydraulic joint according to an embodiment of the invention.

FIG. 4 illustrates a block diagram of a hydraulic joint system 400 including a joint 401. The joint 401 could be a hoist joint 255, crowd joint 245, swing joint 250, or another type of joint in an industrial machine. The joint 401 includes a tank 410, pump 420, a control valve 430, a hydraulically driven element 440, and a release valve 450. The tank 410 stores hydraulic fluid and is coupled to the pump 420. The controller 205 provides control signals to the pump 420 to enable and disable the pump 420. The pump 420, when enabled, pumps hydraulic fluid from the tank 410 and directs the fluid to the control valve 430. The control valve 430 is controlled by the controller 205 to control fluid provided to the hydraulically driven element 440. The release valve 450 is controlled by the controller 450 selectively to allow fluid to return from the hydraulically driven element 440 to the tank 410. In this way, the hydraulic fluid continuously loops through the system at a quantity determined and a pressure controlled by the controller 205. The controller 205 is coupled to and receives data from sensors 350 monitoring the joint 401 to determine a status of the joint 401, such as a position of the joint 401. The sensors 350 are, for example, the crowd sensors 265, swing sensors 270, hoist sensors 275, or shovel sensors 280. Hydraulic fluid in the hydraulically driven element 440 causes movement of the joint, such as causing a crowd joint 245 to extend or retract. Some embodiments may have more or fewer components, such as more tanks 410, pumps 420, control valves 430, or release valves 450. In some embodiments, various components of the hydraulic joint system 400 can be shared among multiple joints. For example, the tank 410 can be shared by a hoist joint, a crowd joint, and a swing joint.

Figure 5A:
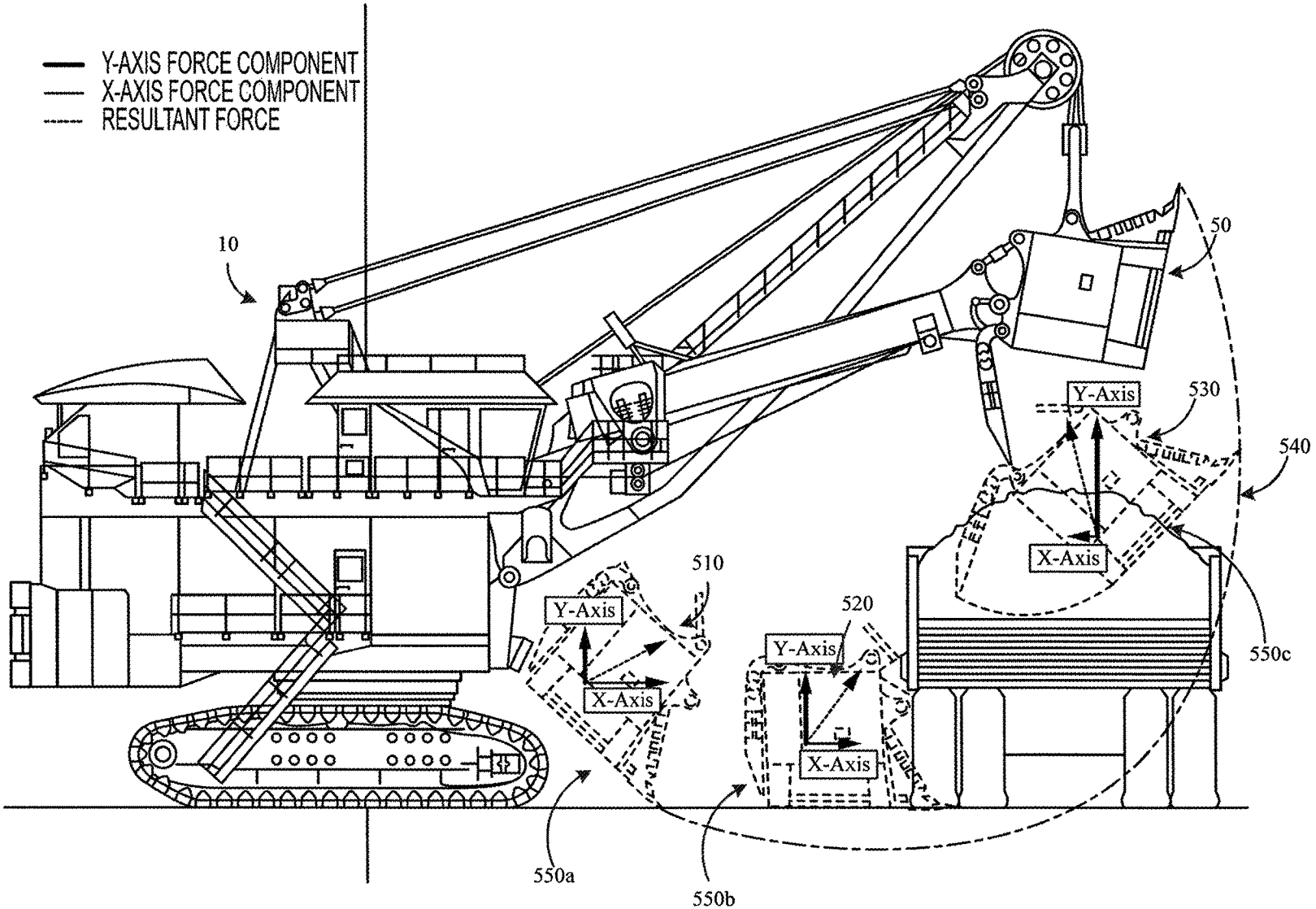
FIGS. 5A, 5B, 5C, and 5D illustrates forces on a dipper at different locations in a digging operation.
Figure 5B:
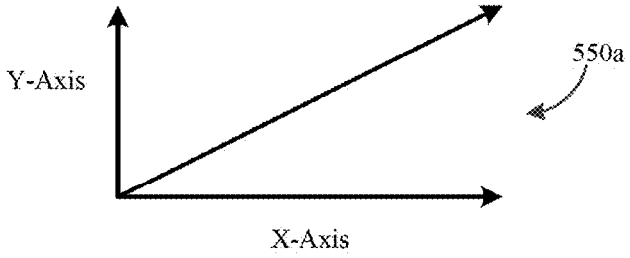
Figure 5C:
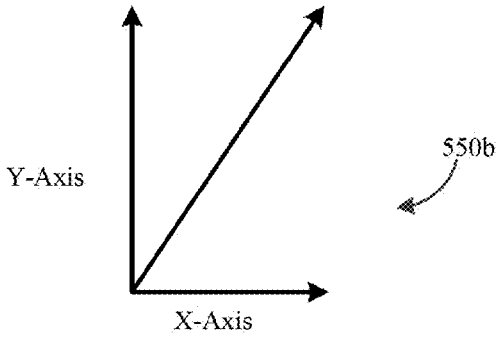
Figure 5D:
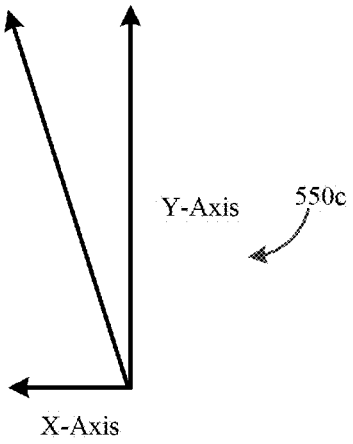

FIG. 5A illustrates joint forces at different locations of the attachment 50 during a digging operation. In FIG. 5A, three different positions 510, 520, and 530 are shown for a path 540 of the attachment 50 during the digging operation. Each location of the attachment 50 has associated force diagram 550*a* shown in FIG. 5B, 550*b* shown in FIG. 5C, and 550*c* shown in FIG. 5D, respectively illustrating an X-axis component of force, a Y-axis component of force, and a resultant force that represents the sum of the X-axis and Y-axis component forces. For example, in FIG. 5B, the X-axis component is greater than the Y-axis component and in FIG. 5C and FIG. 5D, the Y-axis component is greater than the X-axis component. Depending on the magnitude and direction of the X-axis component and the Y-axis component, the resultant forces have different magnitudes and directions.

The resultant force is the force required to move the attachment 50 at each particular location to the next location, such as from position 510 in FIG. 5B to position 520 in FIG. 5C. In this example when the power shovel 10 is digging, a combination of the crowd joint 245 and hoist joint 255 is used to move the attachment 50 from one location to the next. The combination of the crowd joint 245 and hoist joint 255 provide the force in the direction and quantity as illustrated by each resultant force to move the attachment 50. This is just one example of forces on the attachment 50 when the attachment 50 digs, but many different movements utilizing forward and reverse, crowd, hoist and swing, alone or in combination can move the attachment 50 from one location to another, requiring different forces from the joints acting on the attachment 50.

Figure 6:
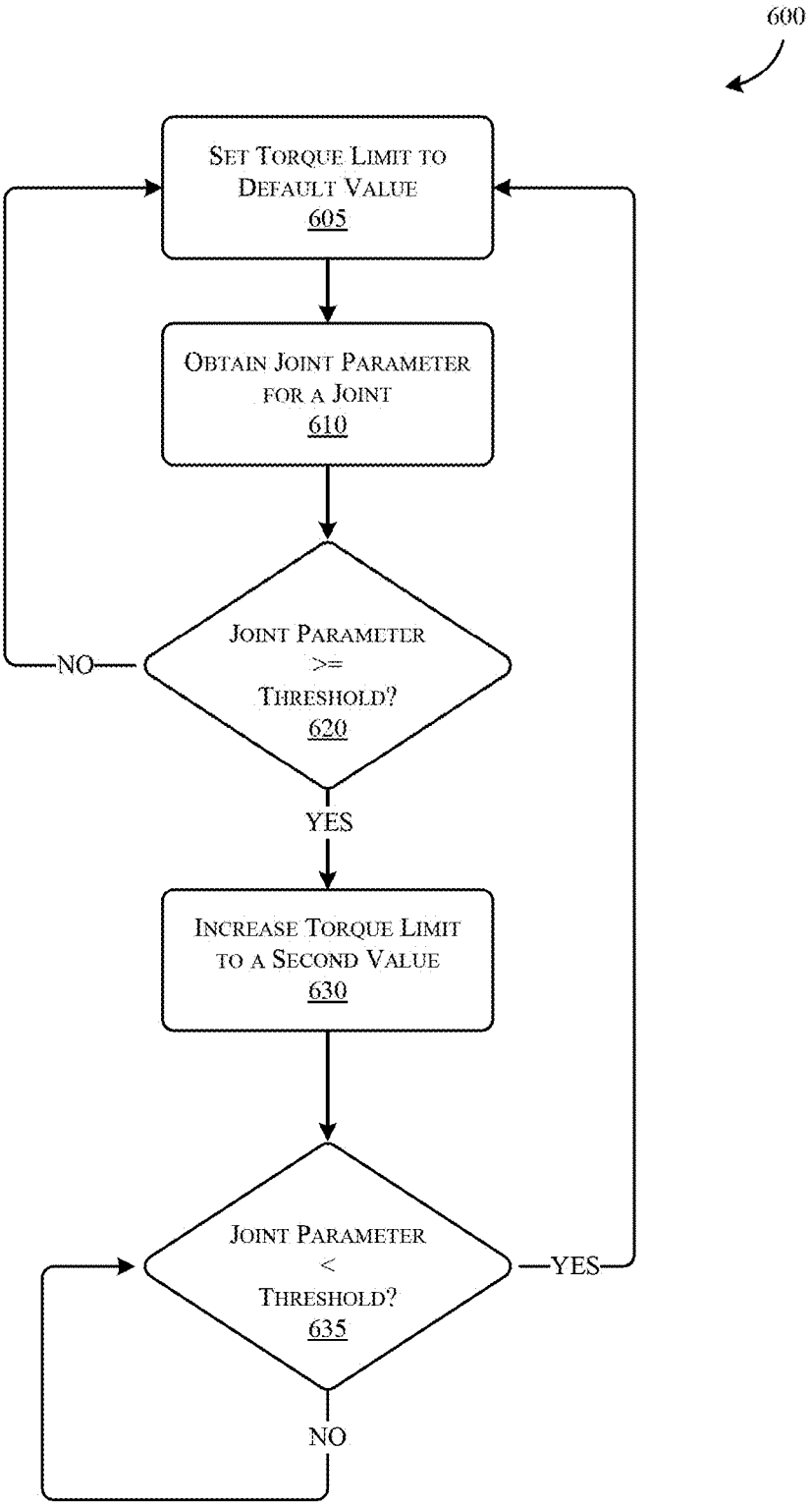
FIG. 6 illustrates a process for preventing a run-away state of an industrial machine.

FIG. 6 illustrates a process 600 for preventing a run-away state of an industrial machine. The process 600 may be implemented by the processor 210. At step 605, the processor 210 sets a force or torque limit of the industrial machine 10 to a default value (e.g., 100%). The default value may be, for example, set at the time of manufacture of the industrial machine 10 or updated in the field by technicians. The default value for the force or torque limit is set in some embodiments to maximize or increase the life and longevity of the components of the industrial machine. The default value of the force or torque limit has a value which, under normal operating conditions of the industrial machine 10, would not be exceeded in order to extend the life of or prevent damage to the machine.

In step 610, the processor 210 obtains a joint parameter of the industrial machine 10 based on one or more of the sensors 263. For example, the joint parameter is obtained for the crowd joint 245, swing joint 250, or hoist joint 255 based on data from an associated one of the crowd sensor 265, swing sensor 270, or hoist sensor 275. For example, the joint parameter may be obtained using either a pose based method (e.g., a time independent method) as shown in and described with respect to FIG. 7, or a dynamic-response based method (e.g., a time dependent method) as shown in and described with respect to FIG. 8. The joint parameter may be, for example, motor acceleration, motor torque, hydraulic pressure, motor current, transmission acceleration, or joint force. The processor implements the process 600 for each industrial machine joint, such as the hoist joint 255, crowd joint 245, and swing joint 250.

After the joint parameter is obtained, the joint parameter is compared to a threshold value in step 620. The comparison of the joint parameter to the threshold value indicates whether there is the potential for an industrial machine to enter a run-away state (e.g., when decelerating). For example, if the acceleration for a joint exceeds an acceleration threshold, then the industrial machine may enter a run-away state when an operator attempts to decelerate the industrial machine. The threshold is, for example, a determined or calculated value or an established threshold selected at the time of manufacture based on defined machine performance characteristics from historical load cases. When the parameter is greater than the threshold, then the force or torque limit is increased to a second value at step 630. For example, the default force or torque limit (e.g., 100%) is increased to a value greater than 100%, such as 150% or 200% for the swing joint 250 and/or hoist joint 255 and 125% for the crowd joint 245. When the force or torque limit is increased to a second value, the industrial machine 10 has more force or torque available to decelerate the industrial machine 10. In some embodiments, increasing the available force or torque is accomplished by permitting (e.g., via software) the controller 205 and the motor drivers 302 to apply more power to the motors 310 than under default settings (e.g., specified in the software). The additional force or torque assists in preventing a run-away state. When the force or torque limit is increased to a second value at step 630, a data entry may be logged for analytical purposes. For example, the processor 210 may maintain a data log on the memory 215 and, upon increasing the force or torque limit in step 630, the processor 210 may create a new entry in the data log including the joint parameter obtained in step 610, the time and date, an operator ID, an industrial machine ID, and an indication of the increase in the force or torque limit.

At step 635, the processor 210 determines whether the joint parameter is less than the threshold value. If the joint parameter is not less than the threshold value, the process 600 remains at step 635 and the force or torque limit remains at the second value. If, at step 635, the joint parameter is less than the threshold value, the process 600 returns to step 605 and the processor 210 sets the force or torque limit back to the default value.

Figure 7:
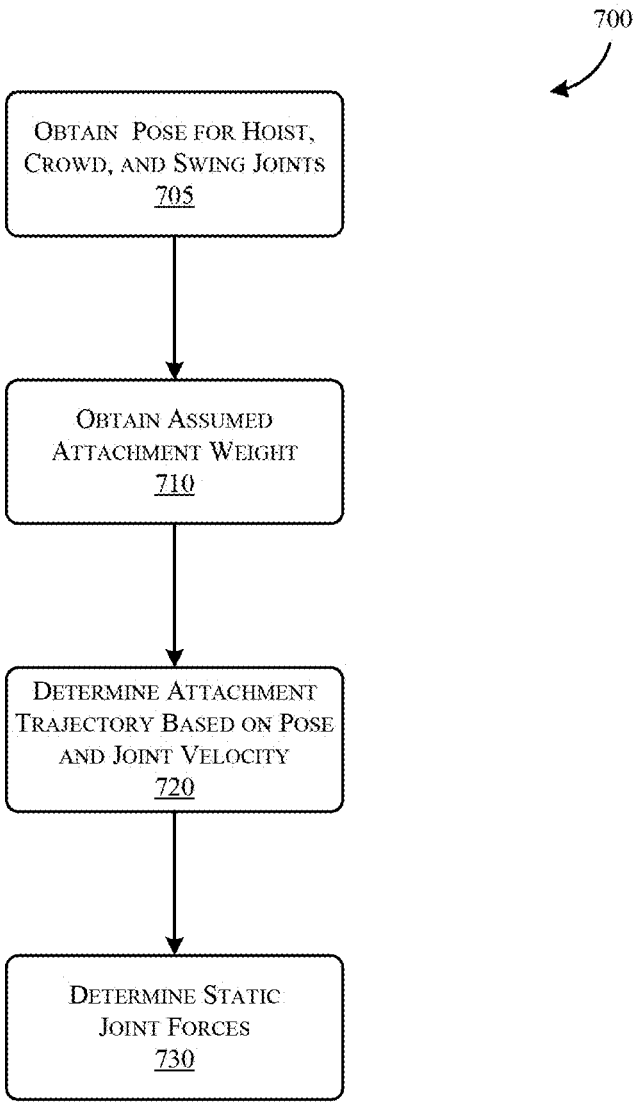
FIG. 7 illustrates a process for obtaining a joint parameter as in FIG. 6 according to an embodiment of the invention.

FIG. 7 illustrates a pose based (time independent) compensation process 700 for obtaining a joint parameter and may be used to implement step 610 of the process 600 in FIG. 6. Pose corresponds to, for example, a position or orientation of the attachment 50 during a digging operation, such as a tuck position, fully-extended handle 45, etc. In step 705, the processor obtains a pose for a hoist joint 255, crowd joint 245, and swing joint 250. In some embodiments, the hoist joint 255, crowd joint 245, and swing joint 250 correspond to the joint 301 of FIG. 3, and the processor 210 obtains the pose from the sensors 350. In some embodiments, the sensors 350 include a resolver indicating a position of the joint 301. At step 710, the processor 210 obtains the assumed weight of the attachment 50. The assumed weight may be obtained using a weight sensor (e.g., of the shovel sensor 250) or determined or calculated weight based on a static level of torque used to hold the attachment 50 in a stationary position. Holding attachment 50 at various poses or positions requires varied amounts of torque at each joint. For example, at position 510 (see FIG. 5A), the torque at the crowd joint is different than in position 530 where the attachment 50 hangs more directly below the sheave 85. In some embodiments, the weight of the attachment 50 is determined or calculated based on the deviation from the normal level of torque used to hold the attachment 50 in a certain position. Additionally or alternatively, the assumed weight may be determined or calculated based on the pose and trajectory of the attachment 50. For example, if the expected trajectory of attachment 50 is from position 510 to 530 based on inputs to the drivers 243, and the attachment 50 moves in a different trajectory, the difference between the expected and actual trajectory can be attributed to the weight of the attachment when known forces are being applied to the attachment 50.

After the assumed attachment weight is obtained, the attachment 50's trajectory is determined or calculated at step 720. The trajectory is determined or calculated using the pose from step 705 and joint velocities. In the embodiment of FIG. 3, the joint velocity is indicated by the speed of the motors 310A and 310B as detected by the sensors 350. In the embodiment of FIG. 4, the joint velocity is indicated by hydraulic pressure as detected by the sensors 350. In some embodiments, the trajectory of the attachment 50 is compared to an operator commanded trajectory to determine if the industrial machine 10 is operating as desired. If the trajectory of the attachment 50 does not match the commanded trajectory, the joints do not have enough available force to meet the operator's commanded trajectory. For example, if the operator attempts to raise the attachment 50 along a path but the attachment 50 doesn't move along that path, forces may be acting on the attachment 50 that the joint actuators are unable to overcome. As a result, additional force (e.g., torque) is required and the force or torque limit can be increased. At step 730, the static joint forces for one or more of the hoist joint 255, crowd joint 245, and swing joint 250 are determined or calculated based on the assumed attachment weight. In some embodiments, the static joint forces are also determined based on the attachment 50's trajectory. In other embodiments, the attachment 50's trajectory is incorporated into or associated with the joint parameter threshold value of step 620 of the process 600 in FIG. 6. The determined or calculated static joint force serves as the obtained joint parameter in step 620 of the process 600 in FIG. 6. As a result, the joint force is compared to threshold value for joint force in step 620. If the joint force is greater than the threshold value, the processor increases the force or torque limit for the industrial machine 10.

Figure 8:
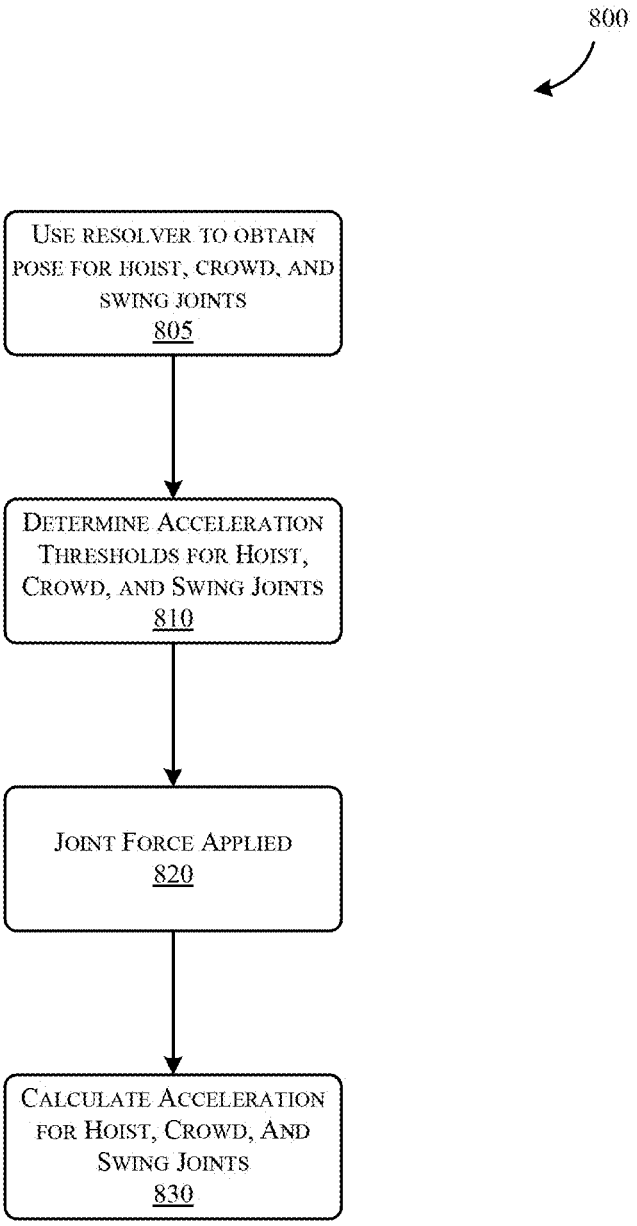
FIG. 8 illustrates a process for obtaining a joint parameter as in FIG. 6 according to another embodiment of the invention.
Figure 9:
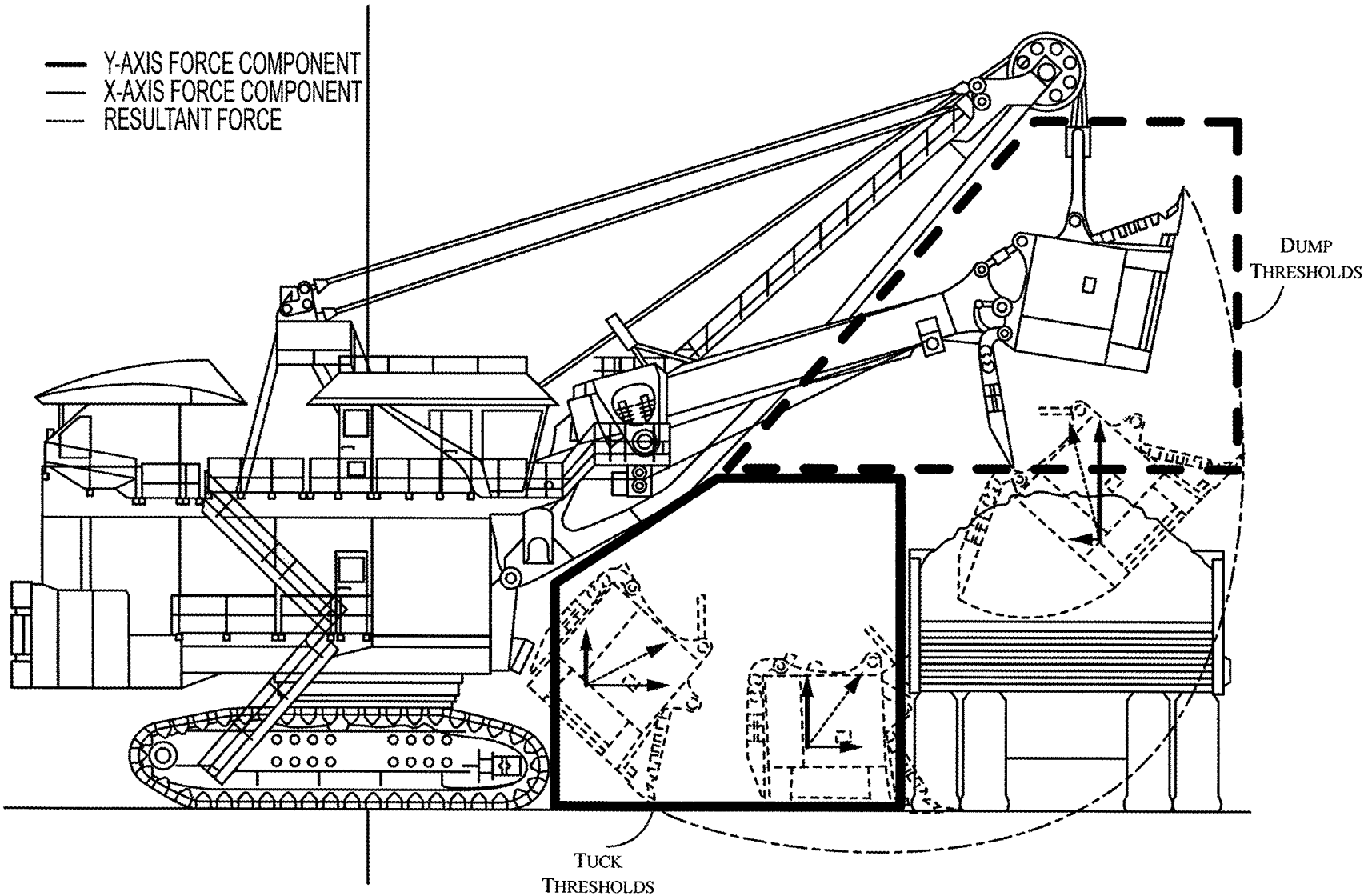
FIG. 9 illustrates industrial machine poses related to acceleration dump threshold values and acceleration tuck threshold values.

FIG. 8 illustrates a dynamic-response based (time dependent) compensation process 800 for obtaining a joint parameter and may be used to implement step 610 of the process 600 in FIG. 6. At step, 805 the processor 210 obtains a pose for a hoist joint 255, crowd joint 245, and swing joint 250. In some embodiments, the hoist joint 255, crowd joint 245, and swing joint 250 correspond to the joint 301 of FIG. 3, and the processor 210 obtains the pose from the sensors 350. In some embodiments, the sensors 350 include a resolver indicating a position of the joint 301. At step 810, one or more acceleration thresholds are determined or calculated for hoist joint 255, crowd joint 245, and swing joint 250 based on the pose from step 800. The acceleration thresholds are based expected acceleration values for various poses throughout a digging operation. For example, acceleration thresholds can vary based on location within a digging envelope (e.g., path 540) or based on relative levels of hoist force vs. crowd force. As illustrated in FIG. 9, acceleration thresholds can correspond to dump thresholds and tuck thresholds based on the industrial machine being in a dump pose or a tuck pose. In some embodiments, the acceleration thresholds are divided into hoist thresholds and crowd thresholds, and the threshold values can vary based on the operation being performed. For example, a crowd extend acceleration threshold may be different than a crowd retract acceleration threshold. Similarly, a hoist raise acceleration threshold may be different than a hoist lower acceleration threshold. As an illustrative example, the dump thresholds for a dump pose are approximately 1 $m/s^2$ for crowd extend, 2 $m/s^2$ for crowd retract, 1 $m/s^2$ for hoist raise, and 1.4 $m/s^2$ for hoist lower. In some embodiments, the acceleration thresholds are set as percentages of default maximum rates. With reference to the previous illustrative example, the acceleration thresholds for crowd extend, crowd retract, hoist raise, and hoist lower correspond to increases of the default maximum rates of approximately 50%, 50%, 30%, and 10%, respectively. Tuck acceleration thresholds can similarly be set for a tuck pose. In some embodiments, the tuck thresholds for a tuck pose are approximately 1.4 $m/s^2$ for crowd extend, 1.4 $m/s^2$ for crowd retract, 0.9 $m/s^2$ for hoist raise, and 1.3 $m/s^2$ for hoist lower. Illustrative tuck acceleration thresholds for crowd extend, crowd retract, hoist raise, and hoist lower correspond to increases of the default maximum rates of approximately 10%, 10%, 50%, and 20%, respectively. The acceleration thresholds can vary by industrial machine based on the machine's capabilities and the above examples are merely illustrative. In other embodiments, acceleration thresholds corresponding to percentage increases of values between 0% and 100% can be set for various operations of the industrial machine based on the performance capabilities of the industrial machine. In some embodiments, the acceleration threshold values are used as the joint parameter threshold in step 620 of the process 600 in FIG. 6.

At step 820, joint force is applied. In the embodiment of FIG. 3, the hoist motors, crowd motors, and swing motors are driven. In the embodiment of FIG. 4, the pump 420 and control valve 430 are controlled by the controller 205 to push hydraulic fluid through the system. After the joint force is applied, the acceleration for the hoist joint 225, crowd joint 245, and swing joint 250 is determined or calculated. The determined or calculated acceleration serves as the obtained joint parameter in step 620 of the process 600 in FIG. 6. As a result, a joint acceleration is compared to a threshold value for joint acceleration in step 620. If the joint is accelerating faster than the acceleration threshold value, the processor 210 increases the force or torque limit for the industrial machine 10.

Thus, the invention provides, among other things, systems and methods for preventing a run-away state in an industrial machine. Various features and advantages of the invention are set forth in the following claims.

What is claimed is:

1. A computer-implemented method of preventing a run-away state of an industrial machine, the industrial machine including a processor, a sensor, a motor driver, and a motor, the method comprising:

setting, using the processor, a torque limit for a joint of the industrial machine to a first torque limit value;

obtaining, using the processor, a joint parameter for the joint of the industrial machine based on an output signal from the sensor;

comparing, using the processor, the joint parameter for the joint to a joint parameter threshold value;

increasing, using the processor, the torque limit for the joint of the industrial machine to a second torque limit value based on the comparison of the joint parameter for the joint to the joint parameter threshold value when the joint parameter is greater than or equal to the joint parameter threshold value; and applying, using the motor drive and the motor, torque to the joint of the industrial machine, wherein the torque applied to the joint of the industrial machine is limited to the second torque limit value.

2. The computer-implemented method of claim 1, wherein the joint of the industrial machine is selected from the group consisting of a crowd joint, a hoist joint, and a swing joint.

3. The computer-implemented method of claim 1, further comprising obtaining, using the processor, a pose for the joint of the industrial machine.

4. The computer-implemented method of claim 3, wherein the pose corresponds to a position of an attachment of the industrial machine during a digging operation.

5. The computer-implemented method of claim 4, further comprising:

determining, using the processor, a weight associated with the attachment of the industrial machine;

determining, using the processor, a trajectory of the attachment of the industrial machine; and determining, using the processor, static joint forces for the joint of the industrial machine.

6. The computer-implemented method of claim 5, wherein the static joint forces correspond to the joint parameter for the joint of the industrial machine.

7. The computer-implemented method of claim 3, further comprising:

determining, using the processor, an acceleration threshold for the joint of the industrial machine;

applying, using the motor drive and the motor, torque to the joint of the industrial machine, wherein the torque applied to the joint of the industrial machine is limited to the first torque limit value; and determining, after applying torque to the joint of the industrial machine, an acceleration of the joint of the industrial machine.

8. The computer-implemented method of claim 7, wherein the acceleration of the joint of the industrial machine corresponds to the joint parameter for the joint of the industrial machine.

9. An industrial machine comprising: a joint; a joint sensor; a motor driver associated with the joint; a motor associated with the motor driver and the joint; and a controller coupled to the joint sensor and the motor driver, the controller including a non-transitory computer readable medium and a processor, the controller comprising computer executable instructions stored in the non-transitory computer readable medium for controlling operation of the industrial machine to: set a torque limit for a joint to a first torque limit value; obtain a joint parameter for the joint based on an output signal from the joint sensor; compare the joint parameter for the joint to a joint parameter threshold value; and increase the torque limit for the joint to a second torque limit value based on the comparison of the joint parameter for the joint to the joint parameter threshold value when the joint parameter is greater than or equal to the joint parameter threshold value, wherein the motor driver is configured to drive the motor to apply torque to the joint, the torque limited to the second torque limit value.

10. The industrial machine of claim 9, wherein the joint is selected from the group consisting of a crowd joint, a hoist joint, and a swing joint.

11. The industrial machine of claim 9, the controller further comprising computer executable instructions stored in the non-transitory computer readable medium for controlling operation of the industrial machine to: obtain a pose for the joint.

12. The industrial machine of claim 11, wherein the pose corresponds to a position of an attachment of the industrial machine during a digging operation.

13. The industrial machine of claim 12, the controller further comprising computer executable instructions stored in the non-transitory computer readable medium for controlling operation of the industrial machine to: determine a weight associated with the attachment of the industrial machine; determine a trajectory of the attachment of the industrial machine; and determine static joint forces for the joint.

14. The industrial machine of claim 13, wherein the static joint forces correspond to the joint parameter for the joint.

15. The industrial machine of claim 11, the controller further comprising computer executable instructions stored in the non-transitory computer readable medium for controlling operation of the industrial machine to: determine an acceleration threshold for the joint; apply torque to the joint, wherein the torque applied to the joint is limited to the first torque limit value; and determine, after applying torque to the joint, an acceleration of the joint.

16. The industrial machine of claim 15, wherein the acceleration of the joint corresponds to the joint parameter for the joint.

17. A controller for preventing a run-away state of an industrial machine, the controller including a non-transitory computer readable medium and a processor, the controller comprising computer executable instructions stored in the non-transitory computer readable medium for controlling operation of the industrial machine to: set a torque limit for a joint of the industrial machine to a first torque limit value; obtain a joint parameter for the joint of the industrial machine based on an output signal from a sensor; compare the joint parameter for the joint to a joint parameter threshold value; increase the torque limit for the joint of the industrial machine to a second torque limit value based on the comparison of the joint parameter for the joint to the joint parameter threshold value when the joint parameter is greater than or equal to the joint parameter threshold value; and apply torque to the joint of the industrial machine, the torque limited to the second torque limit value.

18. The controller of claim 17, wherein the joint is selected from the group consisting of a crowd joint, a hoist joint, and a swing joint.

19. The controller of claim 17, the controller further comprising computer executable instructions stored in the non-transitory computer readable medium for controlling operation of the industrial machine to: obtain a pose for the joint of the industrial machine.

20. The controller of claim 19, wherein the pose corresponds to a position of an attachment of the industrial machine during a digging operation.

21. The controller of claim 20, the controller further comprising computer executable instructions stored in the non-transitory computer readable medium for controlling operation of the industrial machine to: determine a weight associated with the attachment of the industrial machine; determine a trajectory of the attachment of the industrial machine; and determine static joint forces for the joint of the industrial machine.

22. The controller of claim 21, wherein the static joint forces correspond to the joint parameter for the joint of the industrial machine.

23. The controller of claim 19, the controller further comprising computer executable instructions stored in the non-transitory computer readable medium for controlling operation of the industrial machine to: determine an acceleration threshold for the joint of the industrial machine; apply torque to the joint of the industrial machine, wherein the torque applied to the joint of the industrial machine is limited to the first torque limit value; and determine, after applying torque to the joint of the industrial machine, an acceleration of the joint of the industrial machine.

24. The controller of claim 23, wherein the acceleration of the joint of the industrial machine corresponds to the joint parameter for the joint of the industrial machine.

* * * * *